US006390955B1

(12) United States Patent
Wang et al.

(10) Patent No.: US 6,390,955 B1
(45) Date of Patent: May 21, 2002

(54) SAFETY STRIP OF A PROTECTION BOARD OF A TREADMILL

(76) Inventors: Leao Wang; Peter Wu, both of No 1, Lane 233, Sec. 2, Charng Long Road, Taiping (TW), 411

( * ) Notice: Subject to any disclaimer, the term of this patent is extended or adjusted under 35 U.S.C. 154(b) by 0 days.

(21) Appl. No.: 09/596,686

(22) Filed: Jun. 19, 2000

(51) Int. Cl.[7] ..... A63B 22/02
(52) U.S. Cl. ..... 482/54
(58) Field of Search ..... 482/54, 51, 52, 482/57, 148

(56) References Cited

U.S. PATENT DOCUMENTS 4,334,676 A * 6/1982 Schonenberger ..... 482/54
5,711,745 A * 1/1998 Yang ..... 482/54
5,897,460 A * 4/1999 McBride et al. ..... 482/54
6,033,347 A * 3/2000 Dalebout et al. ..... 482/54
6,210,306 B1 * 4/2001 Miller ..... 482/54

* cited by examiner

*Primary Examiner*—Stephen R. Crow
(74) *Attorney, Agent, or Firm*—Kuo-Hsiung Chiu

(57) ABSTRACT

The present invention relates to a safety strip of a protection board of a treadmill disposed between a running belt and a protection board in order to cover the clearance between them so that it can be avoided that the strange things or the hands, the feet and the hair are clamped between them to cause an accident.

2 Claims, 2 Drawing Sheets

SAFETY STRIP OF A PROTECTION BOARD OF A TREADMILL

BACKGROUND OF THE INVENTION

1. Field of the Invention

The present invention relates to a safety strip of a protection board of a treadmill, and more particularly to a protection strip by which the treadmill can be more safely used. In addition, the potential fear of the user in making jogging exercise thereon can be removed.

2. Description of the Prior Art

The conventional treadmill makes use of an electrical motor and a transmission belt to drive rotation wheels which bring a running belt into rotation in order for the user to make a smooth jogging exercise. In order to support the weight of the user, a running board is disposed under the running belt. However, the running belt circles around the running board. Therefore, it would be safer to fit a front and a rear protection board at the front and rear of the running belt for fear that an accident happens when the user can't catch up with the rotation speed of the running belt due to an improper speed adjustment or a relapse of illness so that the feet therefore slip out of the running belt.

Currently, a lot of products are provided with protection boards at the front and rear end of the running belt. However, they ignore the clearance created between the running belt and the front and rear protection board. Accordingly, an accident might happen because the strange things or the hands or the feet of the user are clamped between them.

SUMMARY OF THE INVENTION

It is a primary object of the present invention to provide a safety strip of a protection board of a treadmill which is disposed between the running belt and the rear protection board in order to cover the clearance between them. Therefore, it can be avoided that the strange things or the hands, the feet and the hair are clamped between them to cause an accident.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
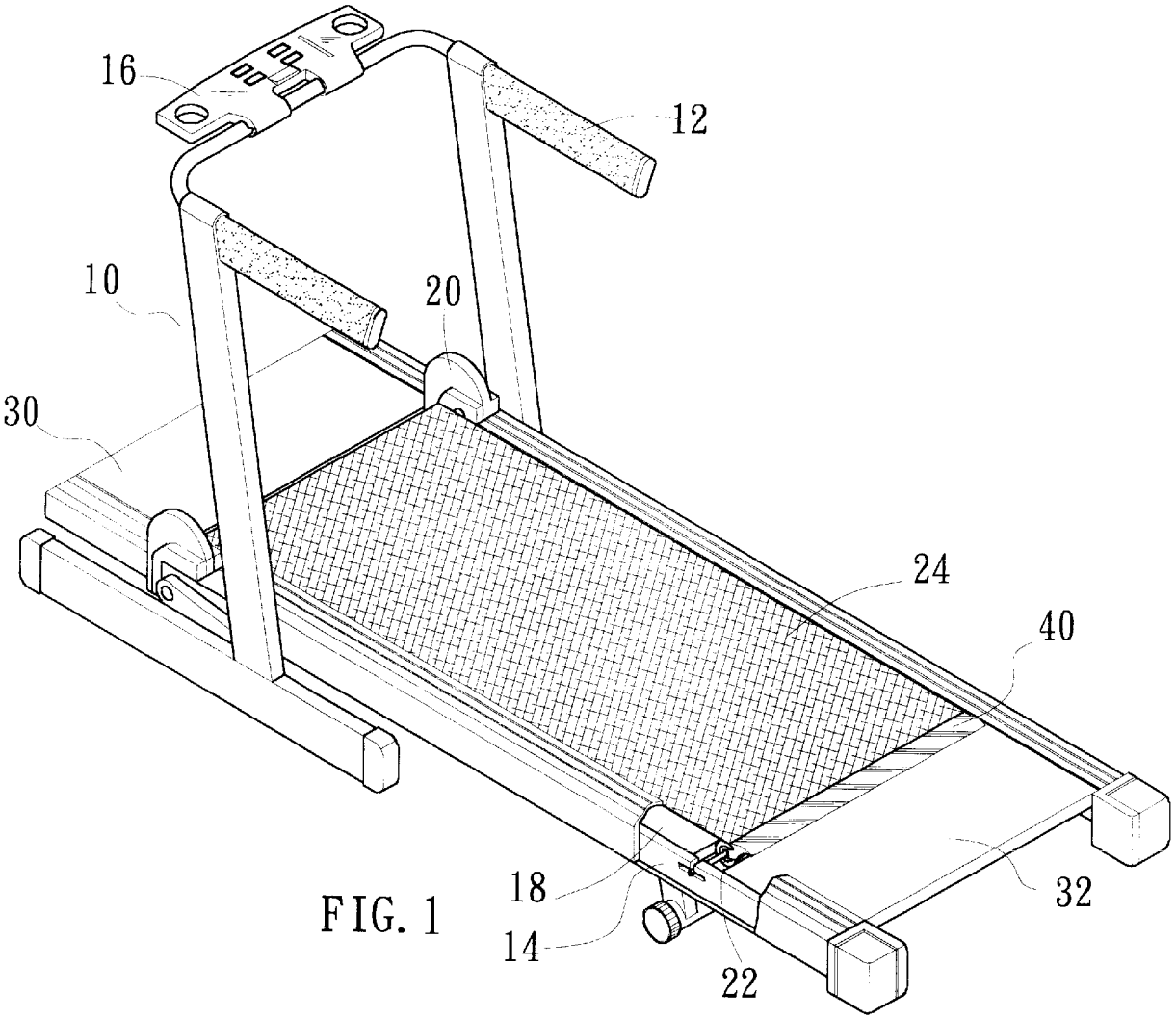
FIG. 1 is a preferred embodiment of the present invention.
Figure 2:
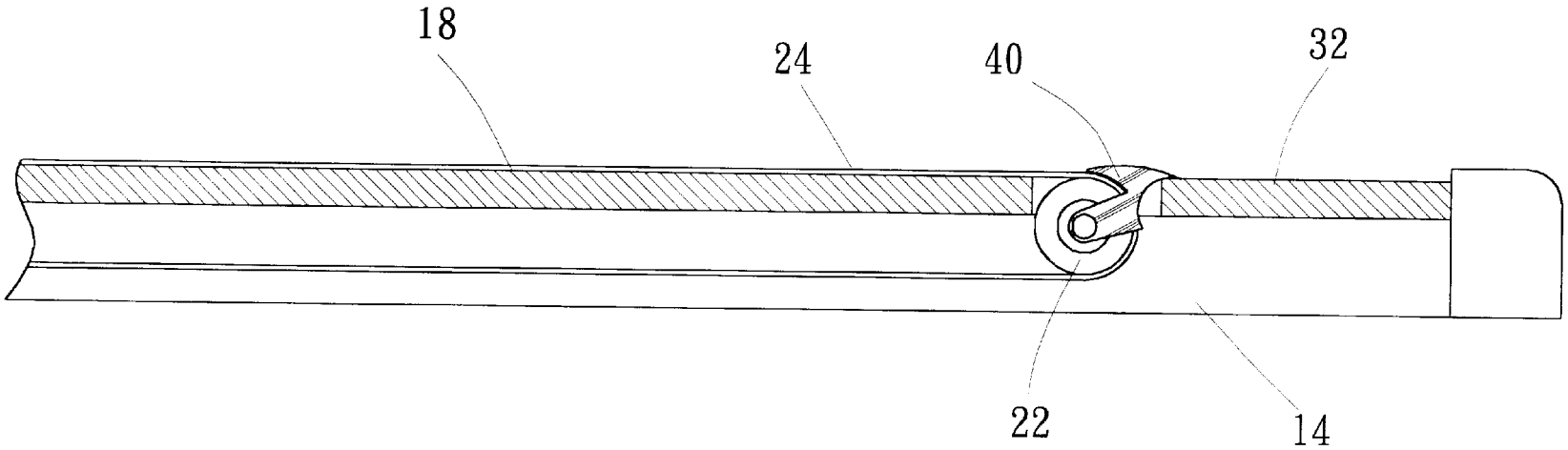
FIG. 2 is a partially sectional view of the preferred embodiment of FIG. 1.

First of all, referring to FIGS. 1 and 2, an exercise treadmill 10 in accordance with the present invention primarily includes a hand rest 2, a main frame 14, an electronic control panel 16 and a motor driving assembly (not shown). The main frame 14 is fitted with protection boards 30, 32 at the front and rear end respectively between which a running board 18 is disposed. A running belt circles around the running board by means of a front and a rear wheel 20, 22 so that the user can stand on the running belt 24 to make the jogging exercise. The present invention is characterized in that a safety strip is disposed between the running belt and the rear protection board for covering the clearance between them. Accordingly, it can be avoided that strange things or the hands, the feet and the hair of the user are clamped between them to cause an accident. Thus, the using safety can be ensured and the treadmill 10 can be protected from damage.

The safety strip 40 can also be installed between the running belt 24 and the front protection board 30. Alternatively, the safety strip 40 can also be installed both between the running belt 24 and the front and the rear protection board 30, 32. This belongs to a simple technique so that it won't be described hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A treadmill comprising:

a) a main frame;

b) a running belt movably mounted on the frame by first and second wheel assemblies;

c) at least one protection board on the main frame adjacent to and spaced from one of the first and second wheel assemblies so as to define a space between an edge of the at least one protection board and the running belt; and, d) a safety strip having a first portion covering the space between the edge of the protection board and the running belt and a second portion mounted to the wheel assembly adjacent to the protection board.

2. The treadmill of claim 1 wherein the running belt has front and rear ends, and further comprising front and rear protection boards mounted on the main frame adjacent to and spaced from the front and rear ends of the running belt, respectively.

* * * * *